US006856306B2

(12) United States Patent
Ito

(10) Patent No.: US 6,856,306 B2
(45) Date of Patent: Feb. 15, 2005

(54) DISPLAY DATA PROCESSING CIRCUIT AND LIQUID CRYSTAL DISPLAY DEVICE

(75) Inventor: Masahiro Ito, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 290 days.

(21) Appl. No.: 10/178,589

(22) Filed: Jun. 24, 2002

(65) Prior Publication Data

US 2003/0006951 A1 Jan. 9, 2003

(30) Foreign Application Priority Data

Jun. 25, 2001 (JP) ..... 2000-192078

(51) Int. Cl.[7] ..... G09G 3/28

(52) U.S. Cl. ..... 345/89; 345/600; 345/690; 345/88; 348/678

(58) Field of Search ..... 345/87–89, 98, 345/99, 204, 690–693, 596, 600, 601, 605; 348/671–686; 358/455–457

(56) References Cited

U.S. PATENT DOCUMENTS 5,555,360 A * 9/1996 Kumazaki et al. ..... 345/443
5,745,087 A * 4/1998 Tomiyoshi et al. ..... 345/89
6,414,664 B1 * 7/2002 Conover et al. ..... 345/89
6,700,559 B1 * 3/2004 Tanaka et al. ..... 345/88

* cited by examiner

*Primary Examiner*—Amr Awad
(74) *Attorney, Agent, or Firm*—Choate, Hall & Stewart

(57) ABSTRACT

A display data processing circuit and liquid crystal display device are provided which are capable of performing conversions between input display data and output display data even with reduced memory capacity. The display data processing circuit includes a storing section to store a power value of a decimal portion of a coefficient setting value, processing section to calculate a power value of an integral portion of the coefficient setting value and to perform a multiplication among the value obtained by the calculation, a value read from the storing section, and a number of gray-scale levels of the input display data, and a look-up table to convert a gray-scale value of input display data to a gray-scale value of output display data based on the coefficient setting value by storing values corresponding to all gray-scale values that the input display data can take on and by reading the value obtained from multiplication by the processing section corresponding to gray-scale values of input display data.

16 Claims, 12 Drawing Sheets

*FIG.2*

| x \ Z | 0 | 0.1 | 0.2 | 0.3 | 0.4 | 0.5 | 0.6 | 0.7 | 0.8 | 0.9 |
|---|---|---|---|---|---|---|---|---|---|---|
| 0 | 1 | 0 | 0 | 0 | 0 | 0 | 0 | 0 | 0 | 0 |
| 1 | 1 | 0.574 | 0.33 | 0.189 | 0.108 | 0.062 | 0.035 | 0.02 | 0.011 | 0.006 |
| 2 | 1 | 0.615 | 0.379 | 0.233 | 0.143 | 0.088 | 0.054 | 0.033 | 0.02 | 0.012 |
| 3 | 1 | 0.641 | 0.411 | 0.263 | 0.169 | 0.108 | 0.069 | 0.044 | 0.028 | 0.018 |
| 4 | 1 | 0.66 | 0.435 | 0.287 | 0.189 | 0.125 | 0.082 | 0.054 | 0.036 | 0.023 |
| 5 | 1 | 0.674 | 0.455 | 0.307 | 0.207 | 0.14 | 0.094 | 0.063 | 0.043 | 0.029 |
| . | | | | | | | | | | |
| . | | | | | | | | | | |
| . | | | | | | | | | | |
| . | | | | | | | | | | |
| 127 | 1 | 0.932 | 0.869 | 0.811 | 0.756 | 0.705 | 0.658 | 0.613 | 0.572 | 0.533 |
| 128 | 1 | 0.933 | 0.871 | 0.813 | 0.759 | 0.708 | 0.661 | 0.617 | 0.576 | 0.537 |
| 129 | 1 | 0.934 | 0.872 | 0.815 | 0.761 | 0.711 | 0.664 | 0.62 | 0.579 | 0.541 |
| . | | | | | | | | | | |
| . | | | | | | | | | | |
| . | | | | | | | | | | |
| . | | | | | | | | | | |
| 250 | 1 | 0.998 | 0.996 | 0.994 | 0.992 | 0.99 | 0.988 | 0.986 | 0.984 | 0.982 |
| 251 | 1 | 0.998 | 0.996 | 0.995 | 0.993 | 0.992 | 0.99 | 0.988 | 0.987 | 0.985 |
| 252 | 1 | 0.998 | 0.997 | 0.996 | 0.995 | 0.994 | 0.992 | 0.991 | 0.99 | 0.989 |
| 253 | 1 | 0.999 | 0.998 | 0.997 | 0.996 | 0.996 | 0.995 | 0.994 | 0.993 | 0.992 |
| 254 | 1 | 0.999 | 0.999 | 0.998 | 0.998 | 0.998 | 0.997 | 0.997 | 0.996 | 0.996 |
| 255 | 1 | 1 | 1 | 1 | 1 | 1 | 1 | 1 | 1 | 1 |

*FIG.3A*

| *storing setion* | *effective numberb of digits:1* |
|---|---|
| X(Input) | b=0.2 |
| 0 | 0 |
| 8 | 0.5 |
| 16 | 0.6 |
| 24 | 0.6 |
| 32 | 0.7 |
| 40 | 0.7 |
| 48 | 0.7 |
| 56 | 0.7 |
| 64 | 0.8 |
| 72 | 0.8 |
| 80 | 0.8 |
| 88 | 0.8 |
| 96 | 0.8 |
| 104 | 0.8 |
| 112 | 0.8 |
| 120 | 0.9 |
| 128 | 0.9 |
| 136 | 0.9 |
| 144 | 0.9 |
| 152 | 0.9 |
| 160 | 0.9 |
| 168 | 0.9 |
| 176 | 0.9 |
| 184 | 0.9 |
| 192 | 0.9 |
| 200 | 1 |
| 208 | 1 |
| 216 | 1 |
| 224 | 1 |
| 232 | 1 |
| 240 | 1 |
| 248 | 1 |
| 255 | 1 |

*FIG.3B*

| | *ideal value* | *set value* | *error* |
|---|---|---|---|
| X(Input) | Y(Output) | Y(Output) | |
| 0 | 0 | 0 | 0 |
| 8 | 0.125588 | 0 | 0.125588 |
| 16 | 0.577053 | 1 | 0.422947 |
| 24 | 1.408045 | 1 | 0.408045 |
| 32 | 2.65144 | 3 | 0.34856 |
| 40 | 4.331953 | 4 | 0.331953 |
| 48 | 6.469676 | 6 | 0.469676 |
| 56 | 9.081664 | 9 | 0.081664 |
| 64 | 12.18282 | 13 | 0.817183 |
| 72 | 15.78641 | 16 | 0.213594 |
| 80 | 19.90443 | 20 | 0.09557 |
| 88 | 24.54786 | 24 | 0.547861 |
| 96 | 29.72682 | 29 | 0.726823 |
| 104 | 35.45073 | 34 | 1.450726 |
| 112 | 41.72837 | 39 | 2.728371 |
| 120 | 48.56803 | 51 | 2.431966 |
| 128 | 55.97753 | 58 | 2.022472 |
| 136 | 63.96426 | 65 | 1.03574 |
| 144 | 72.53528 | 73 | 0.464724 |
| 152 | 81.69729 | 82 | 0.302705 |
| 160 | 91.45675 | 90 | 1.456746 |
| 168 | 101.8198 | 100 | 1.819791 |
| 176 | 112.7924 | 109 | 3.792352 |
| 184 | 124.3801 | 119 | 5.380126 |
| 192 | 136.5886 | 130 | 6.58861 |
| 200 | 149.4231 | 157 | 7.576889 |
| 208 | 162.8888 | 170 | 7.111239 |
| 216 | 176.9905 | 183 | 6.009467 |
| 224 | 191.7332 | 197 | 5.266754 |
| 232 | 207.1216 | 211 | 3.87842 |
| 240 | 223.1601 | 226 | 2.839916 |
| 248 | 239.8532 | 241 | 1.14682 |
| 255 | 255 | 255 | 0 |

*FIG.5A*

| *storing setion* | *effective numberb of digits:3* |
|---|---|
| X(Input) | b=0.2 |
| 0 | 0 |
| 8 | 0.5 |
| 16 | 0.575 |
| 24 | 0.623 |
| 32 | 0.66 |
| 40 | 0.69 |
| 48 | 0.716 |
| 56 | 0.738 |
| 64 | 0.758 |
| 72 | 0.777 |
| 80 | 0.793 |
| 88 | 0.808 |
| 96 | 0.823 |
| 104 | 0.836 |
| 112 | 0.848 |
| 120 | 0.86 |
| 128 | 0.871 |
| 136 | 0.882 |
| 144 | 0.892 |
| 152 | 0.902 |
| 160 | 0.911 |
| 168 | 0.92 |
| 176 | 0.929 |
| 184 | 0.937 |
| 192 | 0.945 |
| 200 | 0.953 |
| 208 | 0.96 |
| 216 | 0.967 |
| 224 | 0.974 |
| 232 | 0.981 |
| 240 | 0.988 |
| 248 | 0.994 |
| 255 | 1 |

*FIG.5B*

| | *ideal value* | *set value* | *error* |
|---|---|---|---|
| X(Input) | Y(Output) | Y(Output) | |
| 0 | 0 | 0 | 0 |
| 8 | 0.125588 | 0 | 0.125588 |
| 16 | 0.577053 | 1 | 0.422947 |
| 24 | 1.408045 | 1 | 0.408045 |
| 32 | 2.65144 | 3 | 0.34856 |
| 40 | 4.331953 | 4 | 0.331953 |
| 48 | 6.469676 | 6 | 0.469676 |
| 56 | 9.081664 | 9 | 0.081664 |
| 64 | 12.18282 | 12 | 0.182817 |
| 72 | 15.78641 | 16 | 0.213594 |
| 80 | 19.90443 | 20 | 0.09557 |
| 88 | 24.54786 | 25 | 0.452139 |
| 96 | 29.72682 | 30 | 0.273177 |
| 104 | 35.45073 | 35 | 0.450726 |
| 112 | 41.72837 | 42 | 0.271629 |
| 120 | 48.56803 | 49 | 0.431966 |
| 128 | 55.97753 | 56 | 0.022472 |
| 136 | 63.96426 | 64 | 0.03574 |
| 144 | 72.53528 | 73 | 0.464724 |
| 152 | 81.69729 | 82 | 0.302705 |
| 160 | 91.45675 | 91 | 0.456746 |
| 168 | 101.8198 | 102 | 0.180209 |
| 176 | 112.7924 | 113 | 0.207648 |
| 184 | 124.3801 | 124 | 0.380126 |
| 192 | 136.5886 | 137 | 0.41139 |
| 200 | 149.4231 | 149 | 0.423111 |
| 208 | 162.8888 | 163 | 0.111239 |
| 216 | 176.9905 | 177 | 0.009467 |
| 224 | 191.7332 | 192 | 0.266754 |
| 232 | 207.1216 | 207 | 0.12158 |
| 240 | 223.1601 | 223 | 0.160084 |
| 248 | 239.8532 | 240 | 0.14682 |
| 255 | 255 | 255 | 0 |

*FIG.12(PRIOR ART)*

| X \ Y | 0 | 0.1 | 0.2 | 0.3 | 0.4 | .... | 2 | .... | 6.2 | 6.3 |
|---|---|---|---|---|---|---|---|---|---|---|
| 0 | 255 | 0 | 0 | 0 | 0 | | 0 | | 0 | 0 |
| 1 | 255 | 146 | 84 | 48 | 28 | | 0 | | 0 | 0 |
| 2 | 255 | 157 | 97 | 59 | 36 | | 0 | | 0 | 0 |
| 3 | 255 | 163 | 105 | 67 | 43 | | 0 | | 0 | 0 |
| 4 | 255 | 168 | 111 | 73 | 48 | | 0 | | 0 | 0 |
| 5 | 255 | 172 | 116 | 78 | 53 | | 0 | | 0 | 0 |
| . | | | | | | | | | | |
| . | | | | | | | | | | |
| . | | | | | | | | | | |
| . | | | | | | | | | | |
| 127 | 255 | 238 | 222 | 207 | 193 | | 63 | | 3 | 3 |
| 128 | 255 | 238 | 222 | 207 | 194 | | 64 | | 3 | 3 |
| 129 | 255 | 238 | 222 | 208 | 194 | | 65 | | 4 | 3 |
| . | | | | | | | | | | |
| . | | | | | | | | | | |
| . | | | | | | | | | | |
| . | | | | | | | | | | |
| 250 | 255 | 254 | 254 | 253 | 253 | | 245 | | 225 | 225 |
| 251 | 255 | 254 | 254 | 254 | 253 | | 247 | | 231 | 231 |
| 252 | 255 | 254 | 254 | 254 | 254 | | 249 | | 237 | 237 |
| 253 | 255 | 255 | 254 | 254 | 254 | | 251 | | 243 | 243 |
| 254 | 255 | 255 | 255 | 254 | 254 | | 253 | | 249 | 249 |
| 255 | 255 | 255 | 255 | 255 | 255 | | 255 | | 255 | 255 |

DISPLAY DATA PROCESSING CIRCUIT AND LIQUID CRYSTAL DISPLAY DEVICE

BACKGROUND OF THE INVENTION

1. Field of the Invention

The present invention relates to a display data processing circuit having a function to convert input display data to output display data according to coefficient setting value and a liquid crystal display device having the display data processing circuit.

The present application claims priority of Japanese Patent Application No.2001-192078 filed on Jun. 25, 2001, which is hereby incorporated by reference.

2. Description of the Related Art

As a display device for a TV (Television) set or a like, a CRT (Cathode Ray Tube) is conventionally widespread and display data having a gamma (γ) characteristic corresponding to a luminance characteristic of the CRT is transmitted from a broadcasting device side.

In contrast, since a liquid crystal panel being gradually and widely used in recent years has a luminance characteristic (or a transmittance) being different from the CRT, in order to correspond to display data having a gamma characteristic being suitable to the CRT, it is necessary to mount a display data processing circuit which can perform compensation (gamma correction) of a luminance characteristic between input display data and output display data.

In the display data processing circuit, by putting data showing a relation between input display data and output display data in a look-up table and by reading a content of the look-up table according to a value of the input display data, a measure is taken to prevent delays in tracing of the output display data from developing when the value of the input display data is changed.

FIG. 11 is a schematic block diagram showing an example of a configuration of a conventional display data processing circuit. As shown in FIG. 11, the conventional display data chiefly includes a processing section 101, a storing section 102, and a look-up table 103. The processing section 101 has an MPU (Micro Processor Unit) (not shown). The MPU operates, in accordance with a program, to read display data corresponding to a coefficient setting value required for a gamma correction and then to set the read display data on a register in the look-up table 103. The storing section 102 is made up of, for example, flush memories and stores all output display data corresponding to all input display data. The look-up table 103 holds display data read by the processing section 101 and outputs a value corresponding to input display data X contained in the held display data as output display data Y.

Next, operations of the conventional display data processing circuit will be described by referring to FIGS. 11 and 12. In the look-up table 103 in the conventional display data processing circuit shown in FIG. 11, conversions are made between input display data X and output display data Y according to a following equation (1):

$$Y=(X/A)\hat{}Z\times B \qquad \text{Equation(1)}$$

where "X" denotes a gray-scale value of input display data, "Y" denotes a gray-scale value of output display data, "Z" denotes a coefficient setting value (for example, "gamma value") made up of positive numbers to one decimal place, "A" denotes a number of gray-scale levels of input display data, "B" denotes a number of gray-scale levels of output display data, and "^" denotes a power calculation.

The storing section 102 stores values obtained by the equation of "Y=(X/A)^Z×B" corresponding to all values that the input display data X and the coefficient setting value Z can take on, in a form of a table. FIG. 12 shows a content of a table stored in the storing section 102 which is made up of values obtained by rounding off a gray-scale value of output display data given by the equation (1), when the input display data X=0 to 255, the coefficient setting value Z=0 to 6.3, the number of gray-scale levels of the input display data A=256, and the number of gray-scale levels of the output display data B=256. The processing section 101 reads data obtained from calculation of the term "(X/A)^Z×B" corresponding to all values that the input display data X can take on, according to a value of the coefficient setting value Z, and outputs the read data to the look-up table 103. The look-up table 103 holds the input data obtained from calculation of the term "(X/A)^Z×B", reads a value obtained from the calculation of the term "(X/A)^Z×B" corresponding to a value of the input display data X according to input of the input display data X, and outputs the read value as output display data Y.

In the display data processing circuit shown in FIG. 11, values obtained by calculation of the term "(X/A)^Z×B" required to produce a register value of the look-up table 103 are stored in the storing section 102 in a manner that values correspond to all values to be obtained from a relation between the input display data X and the coefficient setting value Z.

Therefore, the conventional technology has a problem in that, when a range of a gray-scale value of input display data X is wide or when a range of a value that the coefficient setting value Z can take on is wide, memory capacity of the storing section 102 becomes large and, as a result, a rise in costs is unavoidable. Moreover, there is another problem in that use of many devices causes an increase in power consumption.

SUMMARY OF THE INVENTION

In view of the above, it is an object of the present invention to provide a display data processing circuit and liquid crystal display device which make it unnecessary to store values of output display data, in a form of a table, corresponding to all values of input display data and of a coefficient setting value and which make it possible to perform conversions between input display data and output display data by using reduced memory capacity.

According to a first aspect of the present invention, there is provided a display data processing circuit including:

a storing section to store a power value of a decimal portion of a coefficient setting value of a ratio of a gray-scale value of input display data to a number of gray-scale levels of the input display data;

a processing section to perform an arithmetic operation on a power value of an integral portion of the coefficient setting value of a ratio of the gray-scale value of input display data to a number of gray-scale levels of the input display data and to obtain a value by multiplication among a value acquired by the arithmetic operation, a value read from the storing section, and a number of gray-scale levels of the input display data; and a table section to convert a gray-scale value of the input display data to a gray-scale value of output display data according to the coefficient setting value by storing a value obtained by the multiplication performed by the processing section which corresponds to all values of gray-scale levels that the input display data is able to take on and by reading the value obtained by the multiplication performed by the processing section which corresponds to a gray-scale value of the input display data.

According to a second aspect of the present invention, there is provided a display data processing circuit including;

a storing section to store a value obtained by multiplication between a power value of a decimal portion of a coefficient setting value of a ratio of a gray-scale value of input display data to a number of gray-scale levels of the input display data and a number of gray-scale levels of output display data;

a processing section to perform an arithmetic operation on a power value of an integral portion of the coefficient setting value of a ratio of a gray-scale value of the input display data to a number of gray-scale levels of the input display data and to obtain a value by multiplication between a value obtained by the arithmetic operation and a value read from the storing section; and a table section to convert a gray-scale value of the input display data to a gray-scale value of output display data according to the coefficient setting value by storing the value obtained by multiplication performed by the processing section which corresponds to all gray-scale values that the input display data is able to take on and by reading the value obtained by multiplication performed by the processing section which corresponds to a gray-scale value of the input display data.

In the foregoing, a preferable mode is one wherein the coefficient setting value is an arbitrary fixed value.

Also, a preferable mode is one wherein the coefficient setting value is variable within a range of a change of the gray-scale value.

According to a third aspect of the present invention, there is provided a liquid crystal display device including:

a scanning line driving section to scan a scanning line on each row in every scanning period in a liquid crystal panel in which pixel electrodes are arranged in a manner to correspond to scanning lines on a plurality of rows and to data lines on a plurality of columns;

a reference gray-scale voltage generating section to generate a reference gray-scale voltage which corresponds to a Voltage to Transmittance (V-T) characteristic of each pixel electrode in the liquid crystal panel;

a data line driving section to generate a signal voltage by making a gamma correction to a gray-scale value of display data using the reference gray-scale voltage and to sequentially feed the generated signal voltage to the data line on each column in every scanning period; and wherein the display data processing circuit stated above is provided which operates to convert input display data according to a coefficient setting value and inputs the data to the liquid crystal panel.

In the foregoing, a preferable mode is one wherein the pixel electrode includes a pixel electrode for a red color, a pixel electrode for a green color, and a pixel electrode for a blue color, each being arranged sequentially in a repeated manner in a direction of a scanning line, the reference gray-scale voltage generating section generates a reference gray-scale voltage corresponding to the Voltage to Transmittance characteristic of each color at every time of driving of a data line on each column for the red, green, and blue colors, the data line driving section generates a signal voltage by making a gamma correction to display data of a corresponding color using a reference gray-scale voltage of each of the colors and feeds the generated signal voltage to a data line on each of columns corresponding to the pixel electrode for each of the colors in every scanning period, and the display data processing circuit operates to convert input display data for every color according to the coefficient setting value.

Also, a preferable mode is one wherein the display data processing circuit sequentially converts, in a repeated manner, input display data for each of the red, green, and blue colors, according to the coefficient setting value of each color and produces output display data for the data line driving section.

Also, a preferable mode is one wherein the display data processing circuit is provided in a manner to correspond to input display data for each of the red, blue, and green colors, which operates to convert the input display data according to a coefficient setting value of each color and to produce output display data and then selects the produced output display data for every color and to produce output display data to the data driving section.

Furthermore, a preferable mode is one that wherein includes a window section mounted on a display screen which is used to input a coefficient setting value for the display data processing circuit and which enables an image quality on the display screen to be changed in an arbitrary manner by changing the coefficient setting value through the window section.

With the above configurations, when input display data is converted into output display data based on a coefficient setting value, the processing section produces data corresponding to integral portions of a coefficient setting value by performing a power calculation and the storing section stores only data corresponding to decimal portions of the coefficient setting value and output display data corresponding to input display data is calculated by a result obtained by a multiplication between data produced by arithmetic operational processing and data read from the storing section and therefore conversions between input display data and output display data using the coefficient setting value can be performed by using a storing section even having less storage capacity with high accuracy, which enables reduction of power consumption in the storing section. Moreover, since an image quality can be changed in an arbitrary manner by specifying a coefficient setting value from outside, it is possible to provide a suitable image display that can satisfy a preference of a user.

BRIEF DESCRIPTION OF THE DRAWINGS

The above and other objects, advantages, and features of the present invention will be more apparent from the following description taken in conjunction with the accompanying drawings in which:

FIG. 2 is a diagram showing an example of a content of a table in a storing section according to the first embodiment of the present invention;

FIGS. 3A and 3B are diagrams showing errors between input display data and output display data occurring when an effective number of digits of a value in the storing section is 1 (one);

FIGS. 5A and 5B are diagrams showing errors between input display data and output display data occurring when the effective number of digits of a value in the storing section is 3 (three);

FIG. 12 is a diagram showing an example of a content of a table stored in conventional display data processing.

DETAILED DESCRIPTION OF THE PREFERRED EMBODIMENTS

Best modes of carrying out the present invention will be described in further detail using various embodiments with reference to the accompanying drawings.

First Embodiment

Figure 1:
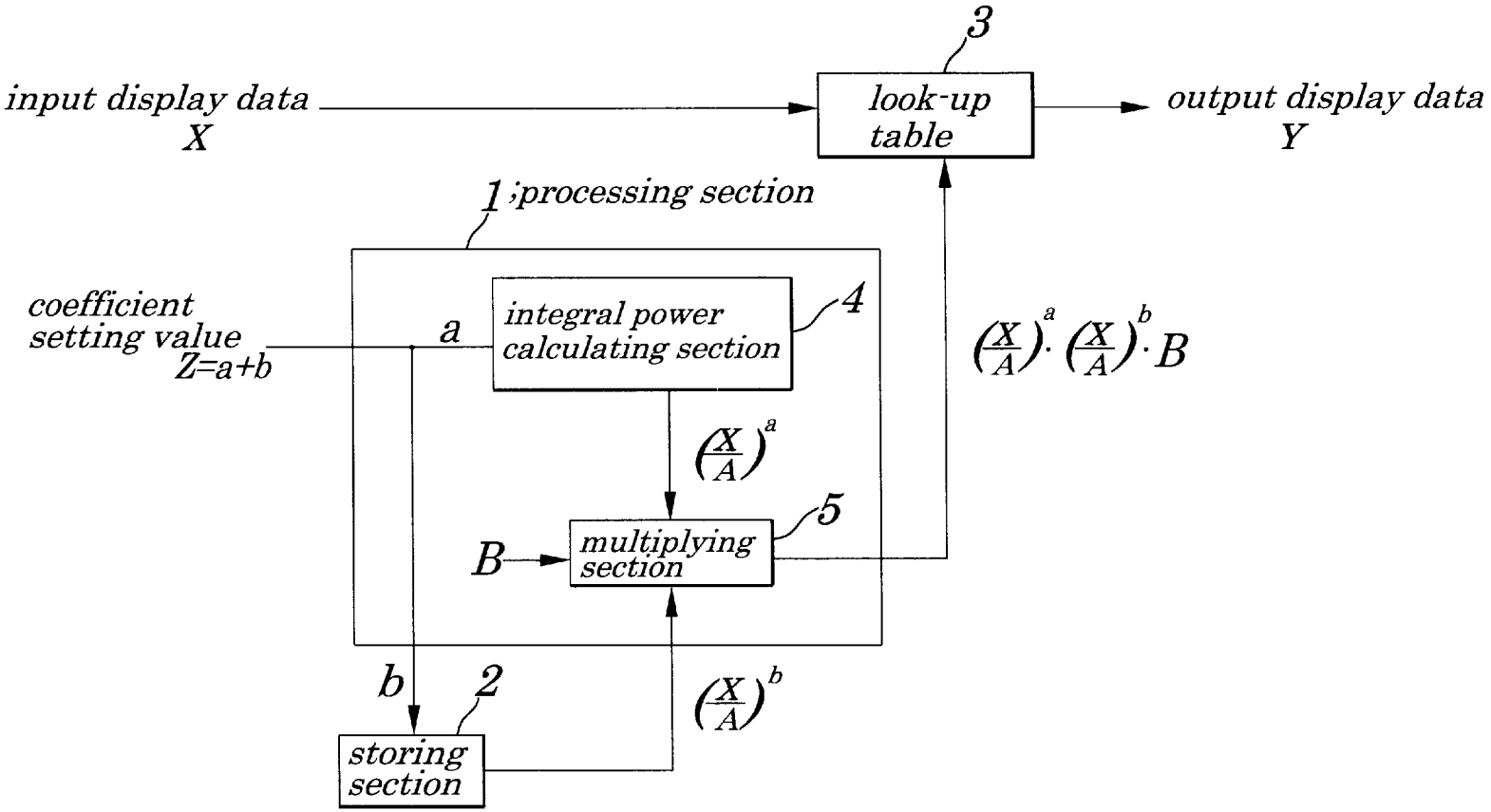
FIG. 1 is a schematic block diagram showing configurations of a display data processing circuit according to a first embodiment of the present invention.
Figure 4:
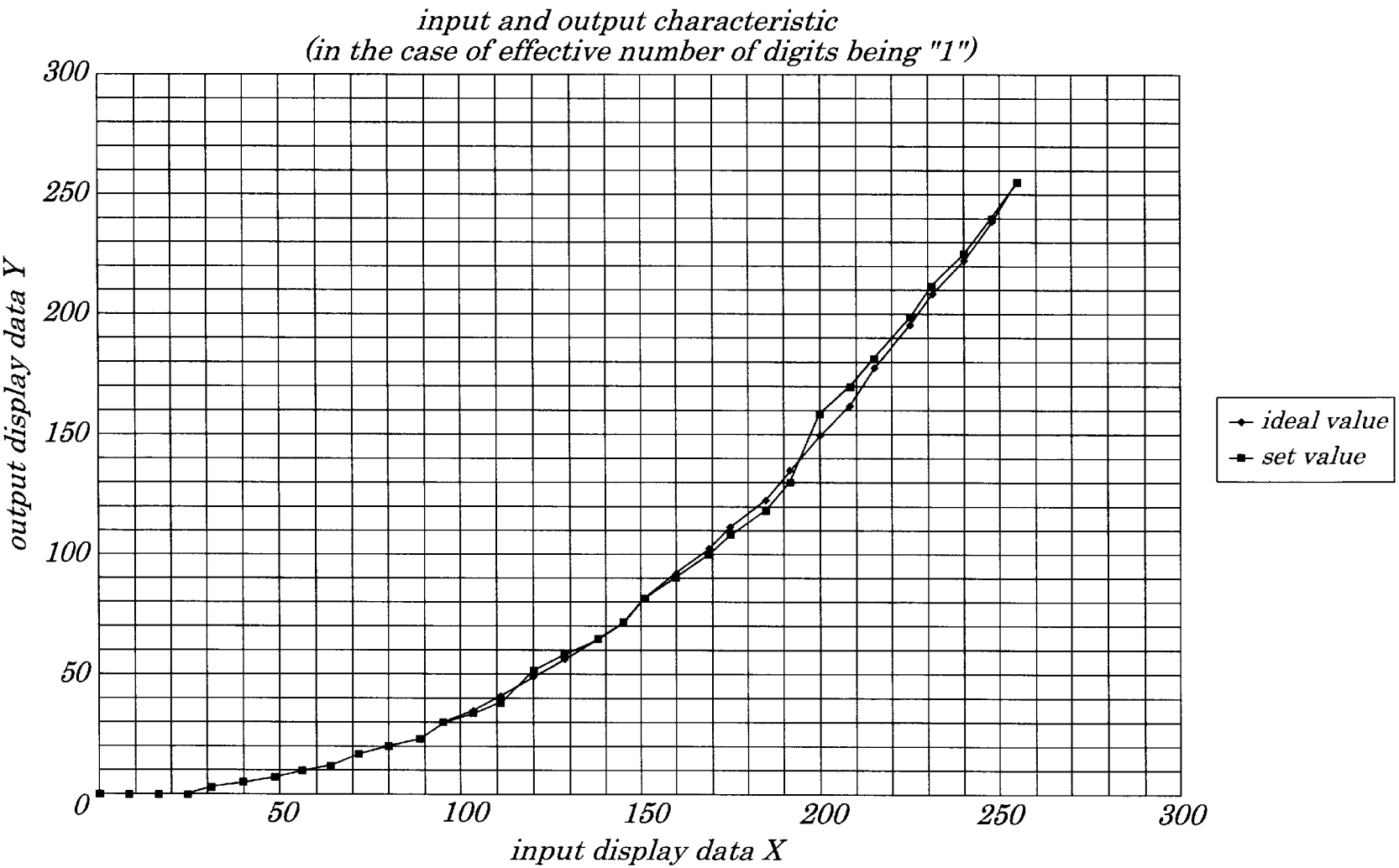
FIG. 4 is a graph showing accuracy of output display data relative to input display data obtained when the effective number of digits of a value in the storing section is 1 (one)
Figure 6:
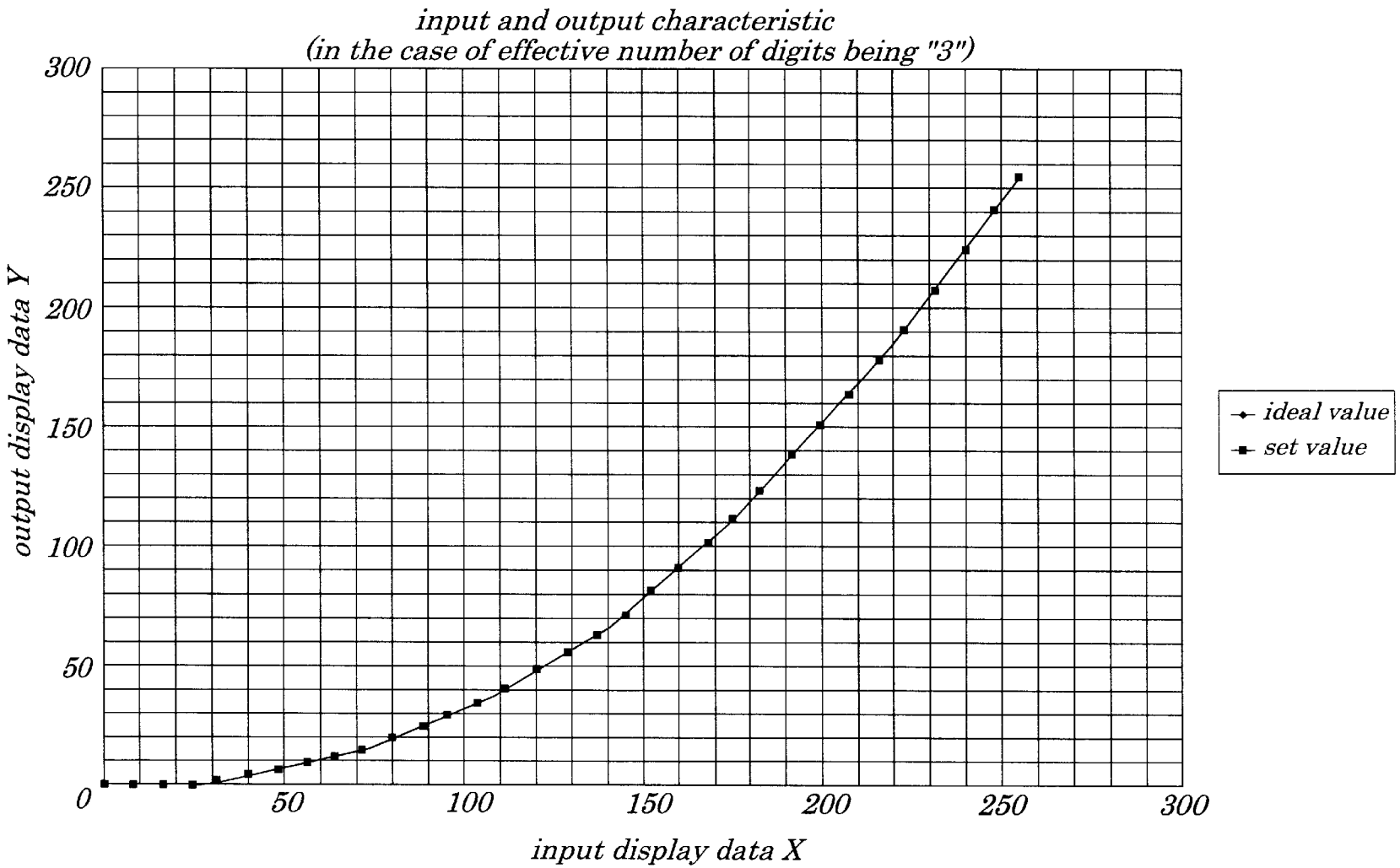
FIG. 6 is a graph showing accuracy of output display data relative to input display data obtained when the effective number of digits of a value in the storing section is 3 (three)

FIG. 1 is a schematic block diagram showing configurations of a display data processing circuit of a first embodiment of the present invention. FIG. 2 is a diagram showing an example of a content of a table in a storing section 2 of the first embodiment of the present invention. FIGS. 3A and 3B are diagrams showing errors between input display data and output display data occurring when an effective number of digits of a value in the storing section is "1" (one). FIG. 4 is a graph showing accuracy of output display data relative to input display data obtained when the effective number of digits of a value in the storing section is "1" (one). FIGS. 5A and 5B are diagrams showing errors between input display data and output display data occurring when the effective number of digits of a value in the storing section is "3" (three). FIG. 6 is a graph showing accuracy of output display data relative to input display data obtained when the effective number of digits of a value in the storing section is "3" (three).

The display data processing circuit of the first embodiment, as shown in FIG. 1, chiefly includes a processing section 1, a storing section 2, and a look-up table 3.

The processing section 1 has an MPU (not shown). The MPU operates according to a program to perform a multiplication among a value obtained from an integral power calculation made by an integral portion of a coefficient setting value Z, a value making up a decimal portion of a coefficient setting value read from the storing section 2 and, a number of gray-scale levels B and to set a result from the multiplication on a register in the look-up table 3. The storing section 2 is made up of, for example, a flash memory (not shown) which stores a table containing data on calculation results corresponding to all values to be obtained from a relation between a decimal portion of the coefficient setting value Z and input display data X. The look-up table 3 holds data on calculation results corresponding to all values for the coefficient setting value Z obtained by the processing section 1 and outputs the value corresponding to the input display data X as output display data Y.

Operations of the display data processing circuit of the first embodiment will be described by referring to FIG. 1 to FIG. 6.

Figure 11:
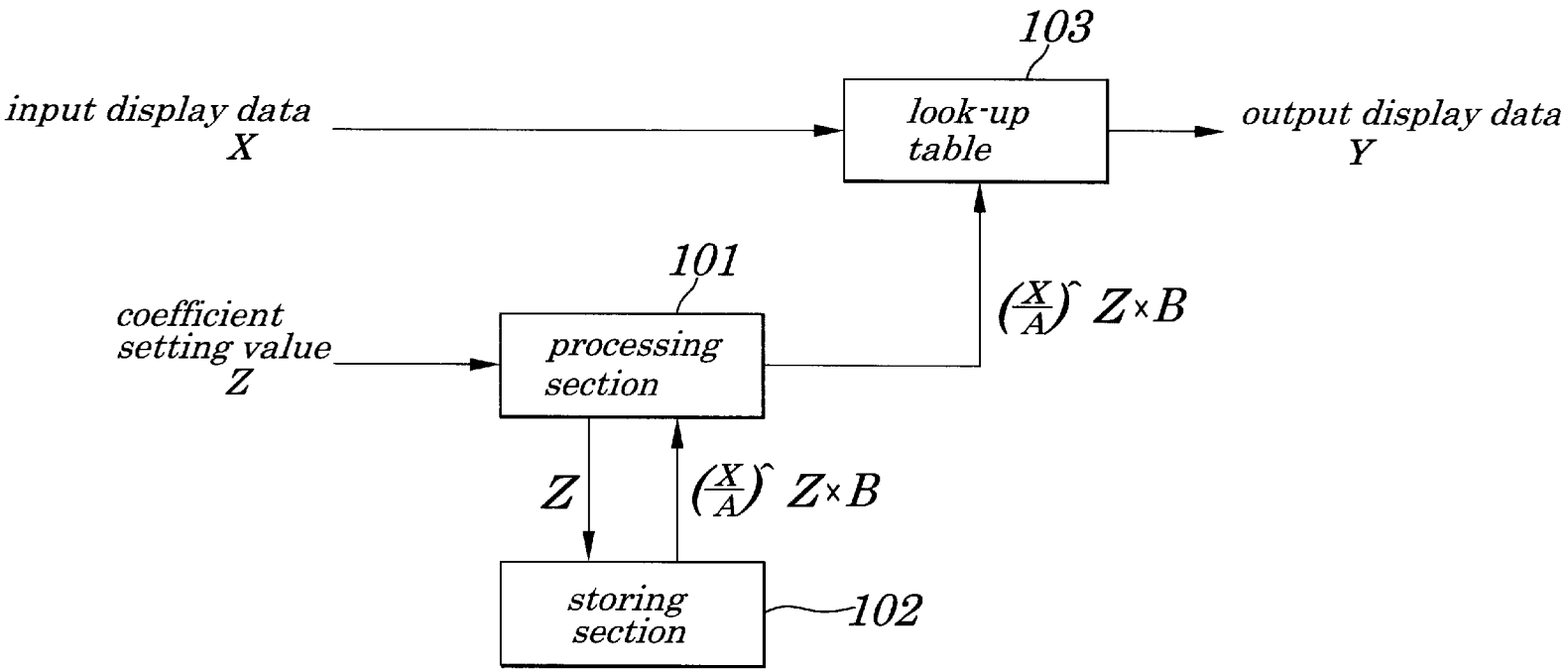
FIG.11(PRIOR ART)
FIG. 11 is a schematic block diagram showing an example of a configuration of a conventional display data processing circuit.

In the display data processing circuit shown in FIG. 1, conversions between input display data X and output display data Y are made, based on the above equation (1), using the look-up table 3. At this point, the processing section 1 transforms the equation (1) into a following equation (2) and performs an arithmetic calculation to obtain output display data Y corresponding to input display data X:

$$Y = (X/A)^Z \cdot B \qquad \text{Equation (2)}$$

$$= (X/A)^{a+b} \cdot B = (X/A)^a \cdot (X/A)^b \cdot B$$

where "a" denotes an integral portion ($a \geqq 0$) of a coefficient setting value Z, "b" denotes a decimal portion ($0 \leqq b \leqq 0.9$), and "b" denotes a value being a first digit to the right of the decimal. Moreover, "X", "Y", "A", and "B" denote the same as in the conventional example shown in FIG. 11.

The processing section 1 includes an integral power calculating section 4 and a multiplying section 5. The integral power calculating section 4, by performing an integral power calculation on "(X/A)" in accordance with a program, obtains a value of $(X/A)^a$ and, at the same time, reads a value of $(X/A)^b$ being stored, in advance, in the storing section 2. The multiplying section 5, by performing a multiplication among the value of $(X/A)^a$, the value of $(X/A)^b$, and a number of gray-scale levels B on every same X value, calculates a value of display data $(X/A)^a \cdot (X/A)^b \cdot B$ corresponding to all values of the input display data X as an integral value and outputs the calculated value as a register value in the look-up table 3.

FIG. 2 shows a content of a table describing a value of $(X/A)^b$ (in the case of effective numbers of digits being "3") that can obtain when input display data X=0 to 255 and when the coefficient setting value Z=0 to 0.9. As shown in FIG. 2, values contained in the content in a table being stored in the storing section 2 are clearly made fine when compared with those contained in the content in the table being stored in a conventional storing section 102 shown in FIG. 12. The look-up table 3 holds display data output from the processing section 1 in the register and outputs a value of $(X/A)^a \cdot (X/A)^b \cdot B$ corresponding to input display data X as output display data Y.

Thus, the display data processing circuit of the first embodiment holds a value of $(X/A)^b$ in a form of the table being stored in its storing section 2 and, by performing a multiplication among a value of $(X/A)^a$ obtained by a calculation by the processing section 1, a value of $(X/A)^b$ read from the storing section 2 and a value of "B" and by obtaining output display data Y, stores the obtained values in the look-up table 3. This is because an integral power calculation using the MPU (not shown) can be easily performed, however, a decimal power calculation using the MPU is difficult in ordinarily cases. In this case, an effective number of digits of a value of $(X/A)^b$ being stored in the storing section 2 causes output display data Y to have a discrepancy or an error from its ideal value. Moreover, since a register value in the look-up table is an integer, a fractional portion of a number is rounded off or dropped. Therefore, by increasing an effective number of digits of a value of $(X/A)^b$ stored in the storing section 2, such the discrepancy or error can be reduced and accuracy of the output display data Y can be raised. For example, when an effective number of digits of a value of $(X/A)^b$ is set to be three and when a result from the arithmetic calculation by the processing section 1 is rounded off, verification made by changing a value of the coefficient setting value Z in a range between 0 to 6.3 indicates that the discrepancy or error becomes smaller than 1.

Now, a discrepancy or an error in a result from a arithmetic calculation by processing section 1 caused by an effective number of digits of a value of $(X/A)^b$ will be described in detail below. Moreover, in the following description, let it be assumed that the coefficient setting value Z=a+b=2.2, a=2, b=0.2, A=256, and B=256.

FIG. 3A shows correspondence between a value of input display data X and a value of $(X/A)^b$ obtained when an effective number of digits of a value of $(X/A)^b$ is 1 (one) and FIG. 3B shows a relation among input display data X, ideal value and calculation result (set value) of output display data Y, and a discrepancy or an error between an ideal value and a set value. Here, the ideal value denotes a value obtained using an expression of $(X/256)^{2.2}$ and the set value denotes a value obtained by multiplying a value stored in the storing section 2 occurring when b=0.2 by a value obtained using the expression of $(X/256)^2$ and then rounding off the value obtained by the multiplication. Moreover, the error is a value of (ideal value−setting value) and is not less than 1 as is shown in FIG. 3, which indicates that an error being not less than one gray-scale level occurs.

FIG. 4 shows an input and output characteristic between an input display data X and output display data Y obtained when an effective number of digits of a value of $(X/A)^b$ is "1" which represents accuracy of a set value for an ideal value, thus indicating that there are some cases in which an error exceeds one gray-scale level.

FIG. 5A shows correspondence between a value of input display data X and a value of $(X/A)^b$ obtained when an effective number of digits of a value of $(X/A)^b$ is 3 (three) and FIG. 5B shows a relation among input display data X, ideal value and calculation result (set value) of output display data Y, and a discrepancy or an error between an ideal value and a set value. Here, the ideal value denotes a value obtained using an expression of $(X/256)^{2.2}$ and the set value denotes a value obtained by multiplying a value stored in the storing section 2 occurring when b=0.2 by a value obtained using the expression of $(X/256\ )^2$ and then rounding off the value obtained by the multiplication. Moreover, the error is a value of (ideal value−setting value) and is not more than 1 as is shown in FIG. 5, which indicates that an error is within one gray-scale level.

FIG. 6 shows an input and output characteristic between an input display data X and output display data Y obtained when an effective number of digits of a value of $(X/A)^b$ is "3" which represents accuracy of a set value for an ideal value, thus indicating that an error is within one gray-scale level.

Thus, according to the display data processing circuit of the first embodiment, processing of data conversion using a coefficient setting value between input display data and output display data can be performed with high accuracy even by a storing section having less memory capacity.

Second Embodiment

Figure 7:
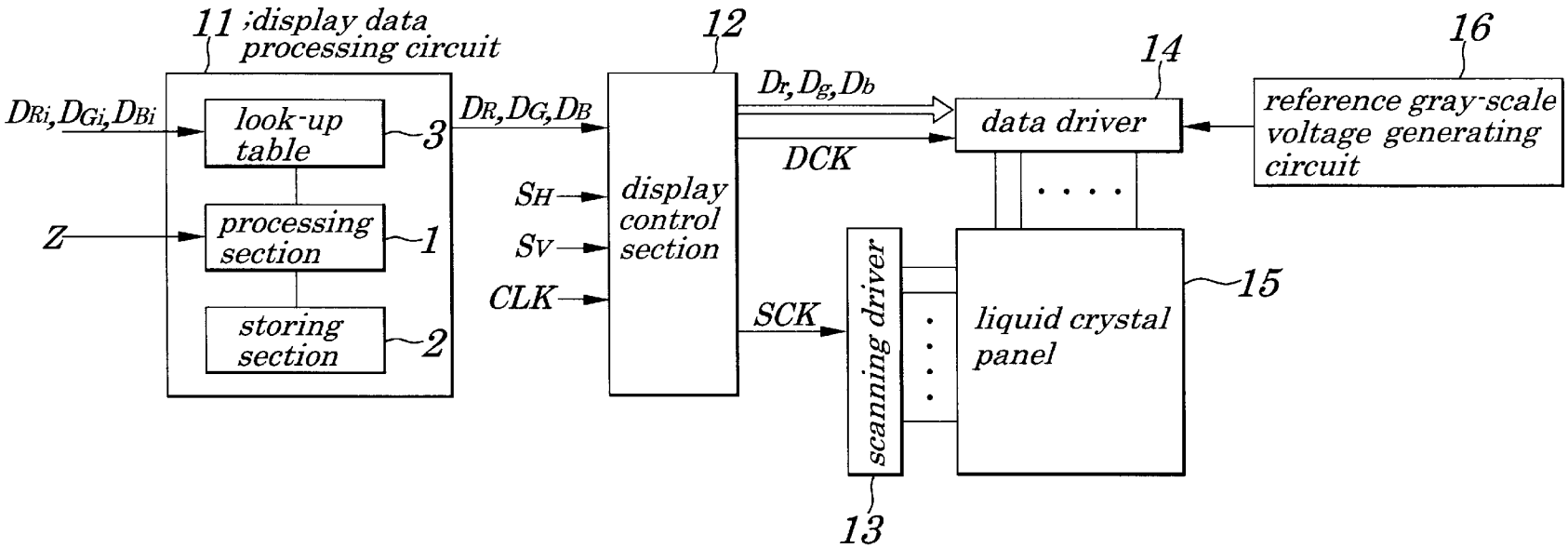
FIG. 7 is a schematic block diagram showing an example of configurations of a liquid crystal display device according to a second embodiment of the present invention.
Figure 8:
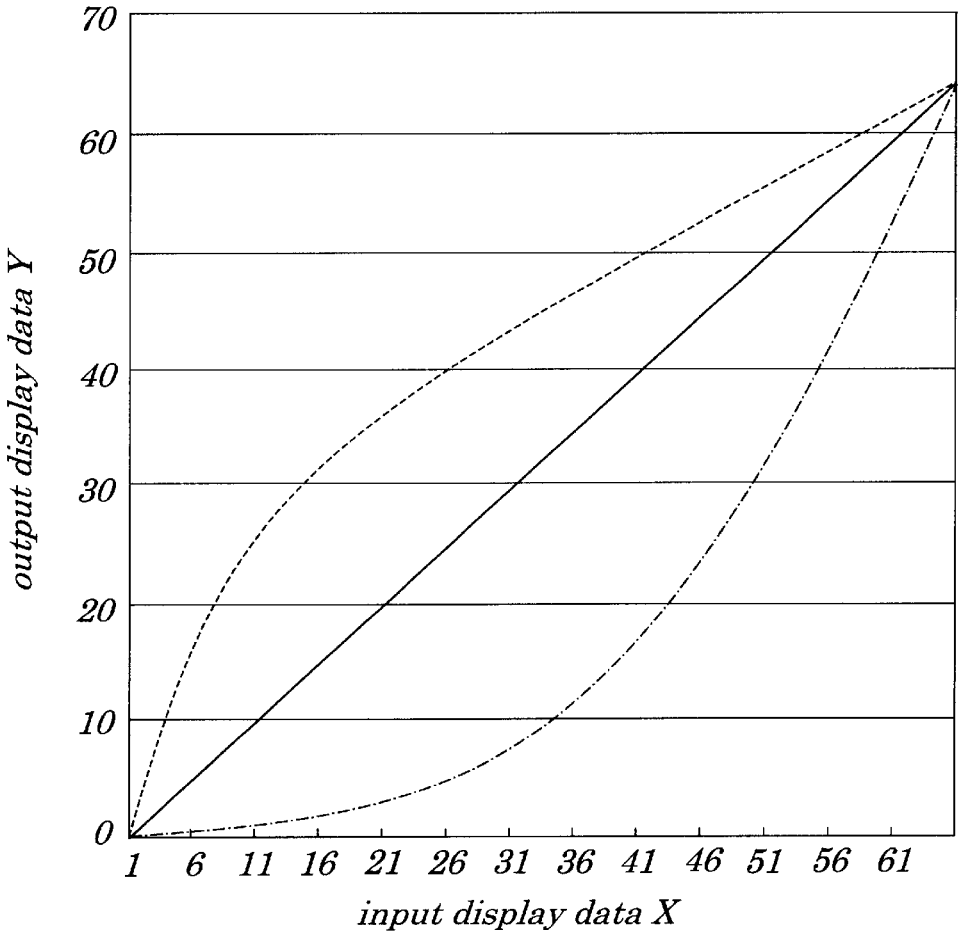
FIG. 8 is a graph showing one example of correspondence between input display data and output display data in a display data processing circuit according to the second embodiment of the present invention.
Figure 9:
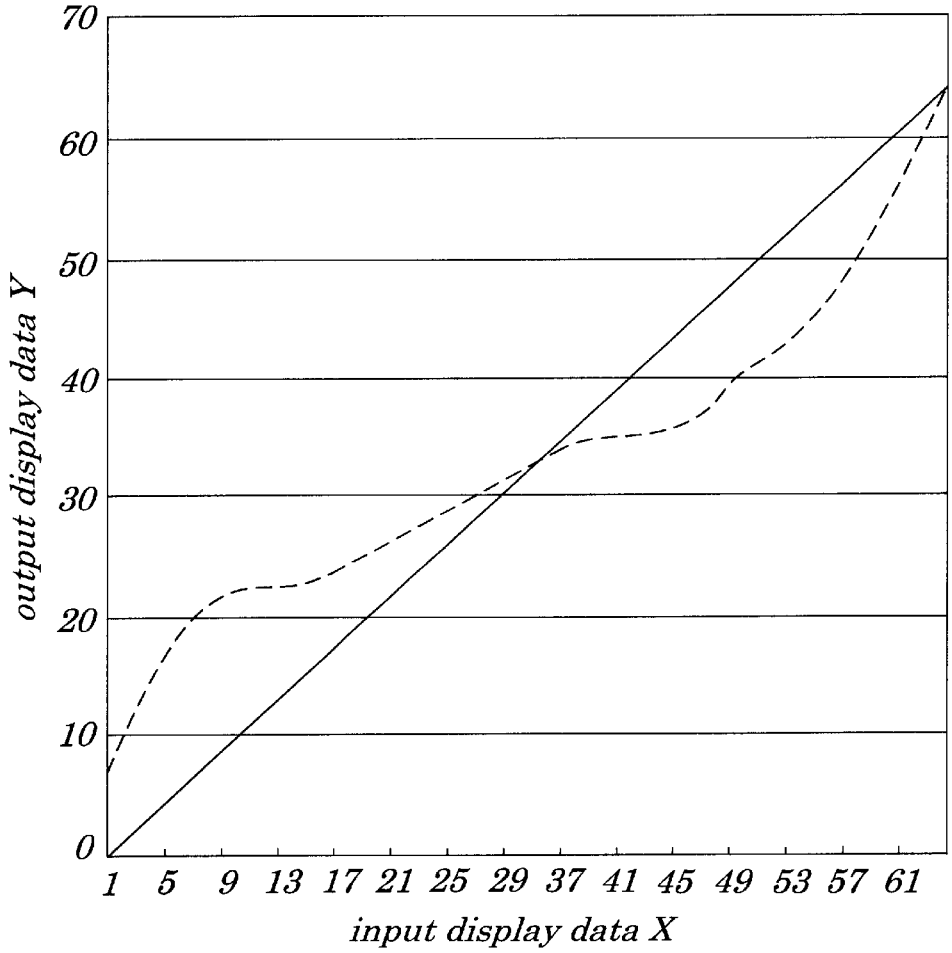
FIG. 9 is a graph showing another example of correspondence between input display data and output display data in a display data processing circuit according to the second embodiment of the present invention.
Figure 10:
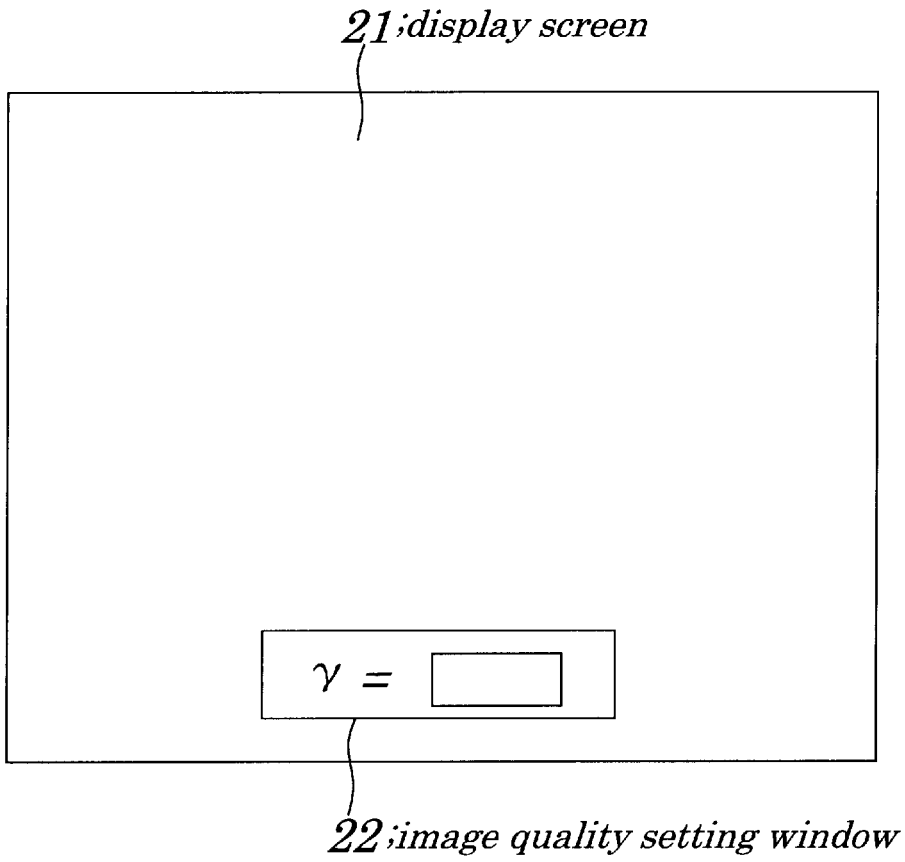
FIG. 10 is a diagram showing an example of a display screen for image quality adjustment of the second embodiment of the present invention.

FIG. 7 is a schematic block diagram showing an example of configurations of a liquid crystal display device according to a second embodiment of the present invention. FIG. 8 is a graph showing one example of correspondence between input display data and output display data in a display data processing circuit according to the second embodiment. FIG. 9 is a graph showing another example of correspondence between input display data and output display data in a display data processing circuit 11 according to the second embodiment. FIG. 10 is a diagram showing an example of a display screen 21 for image quality adjustment of the second embodiment.

The liquid crystal display device of the second embodiment of the present invention, as shown in FIG. 7, chiefly includes the display data processing circuit 11, a display control section 12, a scanning driver 13, a data driver 14, a liquid crystal panel 15, and a reference gray-scale voltage generating circuit 16.

The display data processing circuit 11 has same configurations as those in the first embodiment shown in FIG. 1 and sequentially makes a gamma correction, using a corresponding coefficient setting value Z, to input image data $D_{Ri}$, $D_{Gi}$, and $D_{Bi}$ respectively for a red (R) color, a green (G) color, and a blue (B) color each being input in a timeshared manner from an image signal generating section (not shown) and outputs output image data $D_R$ for the red color, $D_G$ for the green color, and $D_B$ for the blue color. The display control section 12, in response to a horizontal sync signal $S_H$, a vertical sync signal $S_V$, and a clock signal CLK, outputs a scanning clock SCK used to control a scanning signal to a scanning driver 13 and, at the same time, a data clock DCK used to control a data output to the data driver 14 and then, in a repeated manner, outputs output signal data $D_r$, $D_g$, and $D_b$ respectively for red, green, and blue colors.

The scanning driver 13, in synchronization with a scanning clock SCK, sequentially outputs a scanning signal to a plurality of scanning lines (not shown) mounted in a row direction of the liquid crystal panel 15. The data driver 14, based on a reference gray-scale level voltage fed from the reference gray-scale voltage generating circuit 16 and according to the output image data $D_r$, $D_g$, and $D_b$ indicating a gray-scale value fed from the display data processing circuit 11, generates an output voltage for each color having undergone a gamma correction for every display color and, in synchronization with the data clock DCK, sequentially feeds the generated voltage to data lines for respective colors mounted in a column direction of the liquid crystal panel 15.

In the liquid crystal panel 15, pixel electrodes (not shown) are sequentially arranged at every point of intersections in a repeated manner, for example, in a direction of a scanning line. Then, one set of pixel electrodes made up of one for a red color, another for a green color and another for a blue color makes up one color pixel and such the pixels are arranged in a matrix form in row and column directions to form one color screen. An image display of the liquid crystal panel 15 is performed in such a manner that each of the pixel electrodes emits light when a gate of a TFT (Thin Film Transistor) (not shown) being connected between each of the pixel electrodes and each of corresponding data lines is turned ON by a scanning signal fed to a scanning line.

The reference gray-scale voltage generating circuit 16 generates a reference gray-scale voltage used to produce a signal voltage for a data line and feeds it to the data driver 14. Ordinarily, a plurality of the reference gray-scale voltages each being different from each other is fed in order to correspond to a plurality of ranges for gray-scale levels.

Next, operations of the liquid crystal display device of the second embodiment will be described by referring to FIG. 7 to FIG. 10. In the liquid crystal display device shown in FIG.

7, the liquid crystal panel 15 in which 640 pixels are arranged in a column direction and 480 pixels are arranged in a row direction is connected to the scanning driver 13 and to the data driver 14 and a scanning clock SCK is output from the display control section 12 to the scanning driver 13 and a data clock DCK is output from the display control section 12 to the data driver 14. This causes the scanning driver 13 to sequentially output a scanning signal, in every scanning clock SCK, to each of scanning lines forming a screen of one field and, therefore, each of the TFTs being connected to each of the scanning lines is turned ON and a signal voltage is fed from each of the data lines to each of the pixel electrodes being connected to the scanning line.

Moreover, image display is performed in such a manner that the data driver 14 generates a signal voltage obtained by making a gamma correction to image data $D_r$, $D_g$, and $D_b$ respectively for a red, green, and blue color fed from the display control section 12, using a reference gray-scale voltage fed from the reference gray-scale voltage generating circuit 16, so that a characteristic of a signal voltage "V"-luminance (transmittance) "T" in the liquid crystal panel 15 becomes a desired gamma value and outputs the generated voltage to each of the data lines to cause each of the pixel electrodes to emit light at a desired luminance (transmittance).

At this point, the display data processing circuit 11, by sequentially making a gamma correction to input image data for each color using a coefficient setting value Z corresponding to each color in the look-up table 3 and by producing output image data and by feeding it to the display control section 12, can perform an image display having an image quality that matches the V-T characteristic in the liquid crystal panel 15.

A correspondence relation between input display data and output display data differs depending on how a coefficient setting value is given, which causes a change in an image quality of an image to be displayed.

FIG. 8 shows one example of correspondence between input display data X and output display data Y based on a coefficient setting value Z in the look-up table 3 obtained when the coefficient setting value Z is fixed. In FIG. 8, a broken line shows the correspondence between the input display data X and output display data Y obtained when Z=0.5, a solid line shows the correspondence between the input display data X and output display data Y obtained when Z=1 and a dashed line shows the correspondence between the input display data X and output display data Y when Z=2.5. Such an image quality adjustment method in which the coefficient setting value Z is fixed is most suitably used when an image quality of output display data has to be changed for an image quality of input display data, at a specified rate, regardless of a degree of luminance (transmittance) of input display data.

FIG. 9 shows one example of correspondence between input display data X and output display data Y based on the coefficient setting value Z in the look-up table 3 obtained when the coefficient setting value Z is variable.

In FIG. 9, a solid line shows the correspondence between the input display data X and output display data Y obtained when Z=1 (being fixed), a broken line shows the correspondence between the input display data X and output display data Y in which a gray-scale value of the input display data becomes about 1 when Z=0.5, and the gray-scale value of the input display data becomes about 63 when Z=2.5, and that the gray-scale value of the input display data X becomes an intermediate value when Z=1. Such the image quality adjustment method in which the coefficient setting value Z is variable is most suitably used when an image quality of output display data has to be changed depending on whether luminance (transmittance) of the input display data is small or large.

FIG. 10 is a diagram showing an example of the display screen 21 for image quality adjustment of the second embodiment, which shows one example of image quality adjustment in the liquid crystal display device. In the example, the display screen for image quality adjustment fabricated in accordance with an OSD (On Screen Display) is employed. This uses the display screen 21 in a liquid crystal display device making up a monitor being used for a personal computer. As shown in FIG. 10, an image quality setting window 22 is mounted at a part of the display screen 21 in the liquid crystal display device. By setting a coefficient setting value (gamma value) at a specified position in a form of a numerical value or by designating a graduation on a scale of the coefficient setting value using an input device such as a remote controller or a like having a keypad or an infrared-ray device in the image quality setting window 22, a coefficient setting value is specified in a fixed manner. Moreover, it is possible to make variable the coefficient setting value by configuring the image quality setting window 22 so that a coefficient setting value being different in every two or more range of an input gray-scale value is designated.

In these cases, a reading circuit on a side of a monitor reads a coefficient setting value that has been set and feeds the coefficient setting value to the display data processing circuit 11 which then makes conversions between input display data and output display data according to the fed coefficient setting value, thus enabling a user to adjust a display screen of a liquid crystal panel 15 so as to be a desired screen.

Thus, according to the liquid crystal display device of the second embodiment, it is possible to perform processing of data conversions by using a storing section having less storage capacity with higher accuracy and to provide a more suitable image display by feeding a coefficient setting value from outside and changing an image quality.

It is apparent that the present invention is not limited to the above embodiments but may be changed and modified without departing from the scope and spirit of the invention. For example, in the first embodiment, the "(xB) calculation" is performed by the processing section 1 of the display data processing circuit, however, the display data processing circuit may be so configured that the storing section 2 stores data of (X/A)^Z×B corresponding to all the values of the input display data X and the processing section 1 reads data of (X/A)^Z×B according to the coefficient setting value Z and writes the data in the look-up table 3. Moreover, the liquid crystal display of the second embodiment may be so configured that three sets of display data processing circuits are mounted and display data for each of red, green, and blue colors is processed in parallel and output for each color is sequentially switched in the display control section 12 and is fed to the data driver 14.

What is claimed is:

1. A display data processing circuit comprising:

a storing section to store a power value of a decimal portion of a coefficient setting value of a ratio of a gray-scale value of input display data to a number of gray-scale levels of said input display data;

a processing section to perform an arithmetic operation on a power value of an integral portion of said coefficient setting value of a ratio of said gray-scale value of input display data to a number of gray-scale levels of said input display data and to obtain a value by multiplication among a value acquired by said arithmetic operation, a value read from said storing section, and a number of gray-scale levels of said input display data; and a table section to convert a gray-scale value of said input display data to a gray-scale value of output display data according to said coefficient setting value by storing a value obtained by said multiplication performed by said processing section which corresponds to all values of gray-scale levels that said input display data is able to take on and by reading said value obtained by said multiplication performed by said processing section which corresponds to a gray-scale value of said input display data.

2. The display data processing circuit according to claim 1, wherein said coefficient setting value is an arbitrary fixed value.

3. The display data processing circuit according to claim 1, wherein said coefficient setting value is variable within a range of a change of said gray-scale value.

4. A display data processing circuit comprising;

a storing section to store a value obtained by multiplication between a power value of a decimal portion of a coefficient setting value of a ratio of a gray-scale value of input display data to a number of gray-scale levels of said input display data and a number of gray-scale levels of output display data;

a processing section to perform an arithmetic operation on a power value of an integral portion of said coefficient setting value of a ratio of a gray-scale value of said input display data to a number of gray-scale levels of said input display data and to obtain a value by multiplication between a value obtained by said arithmetic operation and a value read from said storing section; and a table section to convert a gray-scale value of said input display data to a gray-scale value of output display data according to said coefficient setting value by storing said value obtained by multiplication performed by said processing section which corresponds to all gray-scale values that said input display data is able to take on and by reading said value obtained by multiplication performed by said processing section which corresponds to a gray-scale value of said input display data.

5. The display data processing circuit according to claim 4, wherein said coefficient setting value is an arbitrary fixed value.

6. The display data processing circuit according to claim 4, wherein said coefficient setting value is variable within a range of a change of said gray-scale value.

7. A liquid crystal display device comprising:

a scanning line driving section to scan a scanning line on each row in every scanning period in a liquid crystal panel in which pixel electrodes are arranged in a manner to correspond to said scanning lines on a plurality of rows and to data lines on a plurality of columns;

a reference gray-scale voltage generating section to generate a reference gray-scale voltage which corresponds to a voltage to transmittance characteristic of each pixel electrode in said liquid crystal panel;

a data line driving section to generate a signal voltage by making a gamma correction to a gray-scale value of display data using said reference gray-scale voltage and to sequentially feed the generated signal voltage to said data line on each column in every scanning period; and a display data processing circuit comprising a storing section to store a power value of a decimal portion of a coefficient setting value of a ratio of a gray-scale value of input display data to a number of gray-scale levels of said input display data; a processing section to perform an arithmetic operation on a power value of an integral portion of said coefficient setting value of a ratio of said gray-scale value of input display data to a number of gray-scale levels of said input display data and to obtain a value by multiplication among a value acquired by said arithmetic operation, a value read from said storing section, and a number of gray-scale levels of said input display data; and a table section to convert a gray-scale value of said input display data to a gray-scale value of output display data according to said coefficient setting value by storing a value obtained by said multiplication performed by said processing section which corresponds to all values of gray-scale levels that said input display data is able to take on and by reading said value obtained by said multiplication performed by said processing section which corresponds to a gray-scale value of said input display data, wherein said display data processing circuit operates to convert input display data according to a coefficient setting value and inputs said data to said liquid crystal panel.

8. The liquid crystal display device according to claim 7, wherein said pixel electrode comprises a pixel electrode for a red color, a pixel electrode for a green color, and a pixel electrode for a blue color, each being arranged sequentially in a repeated manner in a direction of a scanning line, said reference gray-scale voltage generating section generates a reference gray-scale voltage corresponding to a voltage to transmittance characteristic of each color at every time of driving of a data line on each column for said red, green, and blue colors, said data line driving section generates a signal voltage by making a gamma correction to display data of a corresponding color using a reference gray-scale voltage of each of said red, green, and blue colors and to feed said generated signal voltage to a data line on each of columns corresponding to said pixel electrode for each of said red, green, and blue colors in every scanning period, and said display data processing circuit operates to convert input display data for every said red, green, and blue color according to said coefficient setting value.

9. The liquid crystal display device according to claim 8, wherein said display data processing circuit sequentially converts, in a repeated manner, input display data for each of said red, green, and blue colors, according to said coefficient setting value of each said red, green, and blue color and produces output display data for said data line driving section.

10. The liquid crystal display device according to claim 8, wherein said display data processing circuit is provided in a manner to correspond to input display data for each of said red, blue, and green colors, which operates to convert said input display data according to a coefficient setting value of each color and to produce output display data and then selects the produced output display data for every color and to produce output display data to said data driving section.

11. The liquid crystal display device according to claim 7, further comprising a window section mounted on a display screen which is used to input a coefficient setting value for said display data processing circuit and which enables an image quality on said display screen to be changed in an arbitrary manner by changing said coefficient setting value through said window section.

12. A liquid crystal display device comprising:

a scanning line driving section to scan a scanning line on each row in every scanning period in a liquid crystal panel in which pixel electrodes are arranged in a manner to correspond to said scanning lines on a plurality of rows and to data lines on a plurality of columns;

a reference gray-scale voltage generating section to generate a reference gray-scale voltage which corresponds to a voltage to transmittance characteristic of each pixel electrode in said liquid crystal panel;

a data line driving section to generate a signal voltage by making a gamma correction to a gray-scale value of display data using said reference gray-scale voltage and to sequentially feed the generated signal voltage to said data line on each column in every scanning period; and a display data processing circuit comprising; a storing section to store a value obtained by multiplication between a power value of a decimal portion of a coefficient setting value of a ratio of a gray-scale value of input display data to a number of gray-scale levels of said input display data and a number of gray-scale levels of output display data; a processing section to perform an arithmetic operation on a power value of an integral portion of said coefficient setting value of a ratio of a gray-scale value of said input display data to a number of gray-scale levels of said input display data and to obtain a value by multiplication between a value obtained by said arithmetic operation and a value read from said storing section; and a table section to convert a gray-scale value of said input display data to a gray-scale value of output display data according to said coefficient setting value by storing said value obtained by multiplication performed by said processing section which corresponds to all gray-scale values that said input display data is able to take on and by reading said value obtained by multiplication performed by said processing section which corresponds to a gray-scale value of said input display data, wherein said display data processing circuit operates to convert input display data according to a coefficient setting value and inputs said data to said liquid crystal panel.

13. The liquid crystal display device according to claim 12, wherein said pixel electrode comprises a pixel electrode for a red color, a pixel electrode for a green color, and a pixel electrode for a blue color, each being arranged sequentially in a repeated manner in a direction of a scanning line, said reference gray-scale voltage generating section generates a reference gray-scale voltage corresponding to a voltage to transmittance characteristic of each color at every time of driving of a data line on each column for said red, green, and blue colors, said data line driving section generates a signal voltage by making a gamma correction to display data of a corresponding color using a reference gray-scale voltage of each of said red, green, and blue colors and to feed said generated signal voltage to a data line on each of columns corresponding to said pixel electrode for each of said red, green, and blue colors in every scanning period, and said display data processing circuit operates to convert input display data for every said red, green, and blue color according to said coefficient setting value.

14. The liquid crystal display device according to claim 13, wherein said display data processing circuit sequentially converts, in a repeated manner, input display data for each of said red, green, and blue colors, according to said coefficient setting value of each said red, green, and blue color and produces output display data for said data line driving section.

15. The liquid crystal display device according to claim 13, wherein said display data processing circuit is provided in a manner to correspond to input display data for each of said red, blue, and green colors, which operates to convert said input display data according to a coefficient setting value of each color and to produce output display data and then selects the produced output display data for every color and to produce output display data to said data driving section.

16. The liquid crystal display device according to claim 13, further comprising a window section mounted on a display screen which is used to input a coefficient setting value for said display data processing circuit and which enables an image quality on said display screen to be changed in an arbitrary manner by changing said coefficient setting value through said window section.

* * * * *